US008492982B2

(12) United States Patent
Hagino et al.

(10) Patent No.: US 8,492,982 B2
(45) Date of Patent: Jul. 23, 2013

(54) CURRENT DRIVE CIRCUIT FOR LIGHT EMITTING DIODE

(75) Inventors: Junichi Hagino, Kyoto (JP); Shingo Haruta, Kyoto (JP)

(73) Assignee: Rohm Co., Ltd. (JP)

( * ) Notice: Subject to any disclaimer, the term of this patent is extended or adjusted under 35 U.S.C. 154(b) by 275 days.

(21) Appl. No.: 13/090,357

(22) Filed: Apr. 20, 2011

(65) Prior Publication Data

US 2011/0279043 A1 Nov. 17, 2011

(30) Foreign Application Priority Data

Apr. 23, 2010 (JP) ..... 2010-100240

(51) Int. Cl.
*H05B 37/02* (2006.01)

(52) U.S. Cl.
USPC ..... 315/185 R; 315/192

(58) Field of Classification Search
USPC ..... 315/185 R, 192, 191, 193, 315, 317
See application file for complete search history.

(56) References Cited

U.S. PATENT DOCUMENTS

| | | | | |
|---|---|---|---|---|
| 8,106,604 | B2 * | 1/2012 | Zhao et al. | 315/299 |
| 2010/0013395 | A1 * | 1/2010 | Archibald et al. | 315/185 R |
| 2011/0050110 | A1 * | 3/2011 | Han | 315/185 R |

FOREIGN PATENT DOCUMENTS

| | | |
|---|---|---|
| JP | 2009-188135 | 8/2009 |
| JP | 2010-015967 | 1/2010 |

* cited by examiner

*Primary Examiner* — Daniel D Chang
(74) *Attorney, Agent, or Firm* — Cantor Colburn LLP

(57) ABSTRACT

A pulse width modulated dimming pulse signal PWM is input to a control input terminal P5. A standby terminal P6 receives a standby signal STB that indicates switching between a standby state and an operating state of a current drive circuit 8. A burst dimming terminal BS is provided to each of eight respective channels. Each burst dimming terminal BS receives a voltage at one terminal (cathode) of a corresponding LED string 6. When the voltage level of the standby signal STB is included in a first voltage range, a burst controller 9 is set to an all channel common mode, and when it is included in a second voltage range, the mode is set to a phase shift mode $\phi_{SHIFT}$. The burst controller 9 set to the phase shift mode $\phi_{SHIFT}$ automatically sets the phase shift angle according to the number of connected LED strings 6.

4 Claims, 6 Drawing Sheets

CURRENT DRIVE CIRCUIT FOR LIGHT EMITTING DIODE

BACKGROUND OF THE INVENTION

1. Field of the Invention

The present invention relates to a driving circuit for a light emitting diode.

2. Description of the Related Art

In recent years, as a backlight of a liquid crystal panel or as an illumination device, a light emitting apparatus is employed, which is configured using an LED (light emitting diode). FIG. 1 is a circuit diagram which shows a typical configuration of a light emitting apparatus. A light emitting apparatus 1003 includes multiple LED strings 1006_1 through 1006_n, a switching power supply 1004, and a current drive circuit 1008.

Each LED string 1006 includes multiple LEDs connected in series. The switching power supply 1004 boosts an input voltage Vin, and supplies a driving voltage Vout to one terminal of each of the LED strings 1006_1 through 1006_n.

The current drive circuit 1008 includes current sources $CS_1$ through $CS_n$ which are respectively provided to the LED strings 1006_1 through 1006_n. Each current source CS supplies, to the corresponding LED string 1006, a driving current $I_{LED}$ that corresponds to the target luminance level.

The switching power supply 1004 includes an output circuit 1102 and a control IC 1100. The output circuit 1102 includes an inductor L1, a switching transistor M1, a rectifier diode D1, and an output capacitor C1. The control IC 1100 controls the on/off duty ratio of the switching transistor M1 so as to adjust the driving voltage Vout.

With such a light emitting apparatus 1003, in some cases, in order to adjust the luminance level of each LED string 1006, a PWM (Pulse Width Modulation) control operation is performed on the on period $T_{ON}$ and the off period $T_{OFF}$ of the driving current $I_{LED}$. Such a control operation is also referred to as the "burst dimming control operation" or "burst control operation". Specifically, a burst controller 1009 of the current drive circuit 1008 receives pulse signals $PWM_1$ through $PWM_n$ each having a duty ratio that corresponds to the luminance level so as to perform a switching control operation on the respective current sources $CS_1$ through $Cs_n$.

[Related Art Documents]

[Patent Documents]

[Patent document 1]

Japanese Patent Application Laid Open No. 2010-015967

[Patent document 2]

Japanese Patent Application Laid Open No. 2009-188135

If the driving currents $I_{LED1}$ through $I_{LEDn}$ of the respective channels have uniform phases in the burst dimming operation, the output current Iout of the switching power supply 1004 concentrates at particular timings. In some cases, this becomes a factor contributing to ripple in the output voltage Vout or a cause of undesired noise. This problem can be solved by an arrangement configured to input the burst control signals $PWM_1$ through $PWM_n$ having phases shifted from one another such that the on periods $T_{ON}$ of the respective channels each have a different time offset.

However, with such a method (which is referred to as the "phase shift burst dimming method"), there is a need to generate the burst control signals $PWM_1$ through $PWM_n$ by means of a processor (DSP) external to the light emitting apparatus 1003, which imposes a heavy burden on the designer of liquid crystal TVs.

Furthermore, in a case in which there is a desire to make a design change with respect to the number of channels of LED strings, there is a need to change the design of the circuit configured to generate the burst control signals $PWM_1$ through $PWM_n$ This leads to a problem of increased design costs.

SUMMARY OF THE INVENTION

The present invention has been made in order to solve such a problem. Accordingly, it is an exemplary purpose of an embodiment of the present invention to provide a current drive circuit which is capable of providing a phase shift burst dimming operation in a simple manner.

An embodiment of the present invention relates to a current drive circuit. The current drive circuit is configured to allow a maximum of eight channels of light emitting diode strings to be connected, and to drive the light emitting diode strings thus connected.

The current drive circuit comprises: a control input terminal configured to receive a pulse width modulated dimming pulse signal; a standby terminal configured to receive a standby signal which is an instruction to switch the state of the current drive circuit between a standby state and an operating state; eight burst dimming terminals respectively provided to the channels, and each connected to one terminal of the corresponding light emitting diode string; and a controller configured such that, when the voltage level of the standby signal is included in a first voltage range, the operating mode is set to an all channel common mode in which the light emitting diode strings of the respective channels are each driven using a corresponding driving current having the same phase, and when the voltage level of the standby signal is included in a second voltage range, the mode is set to a phase shift mode in which the light emitting diode strings of the respective channels are each driven using a corresponding driving current having a shifted phase.

The controller set to the phase shift mode performs a driving operation such that, when the electric potentials at the burst dimming terminals of the fifth through eighth channels are all lower than a predetermined second threshold voltage in a judgment period, the mode is set to a 90-degree phase shift mode in which the light emitting diode strings of the first through fourth channels are driven in a driving period after the judgment period using respective driving currents the phases of which are shifted from one another by ¼ the period of the dimming pulse signal. When the electric potentials at the burst dimming terminals of the seventh and eighth channels are all lower than the predetermined second threshold voltage in the judgment period, the controller is set to a 60-degree phase shift mode in which the light emitting diode strings of the first through sixth channels are driven in the driving period after the judgment period using respective driving currents the phases of which are shifted from one another by ⅙ the period of the dimming pulse signal. In cases other than the foregoing, the controller is set to a 45-degree phase shift mode in which the light emitting diode strings of the first through eighth channels are driven in the driving period after the judgment period using respective driving currents the phases of which are shifted from one another by ⅛ the period of the dimming pulse signal.

With a typical IC (Integrated Circuit), when the standby signal is set to the first level (e.g., high level), the IC is set to the operating state, and when the standby signal is set to the second state (low level), the IC is set to the standby state. In contrast, the current drive circuit is capable of switching the mode between the all channel common mode and the phase shift mode using the voltage level of the standby signal which indicates the operating state.

Furthermore, when a light emitting diode string is connected to a given channel, the voltage level at the burst dimming terminal of that given channel becomes higher than a predetermined threshold voltage, and when no light emitting diode string is connected to the channel, the voltage level thereof becomes lower than the threshold voltage. Such a current drive circuit is capable of detecting the number of connected LED strings. Thus, such an arrangement is capable of automatically setting the phase shift angle according to the number of connected LED strings thus detected.

That is to say, when the standby signal is included in the first voltage range, all the channels are driven with the same phase. When the standby signal is included in the second voltage range, the mode can be switched between the 90-degree phase shift mode, the 60-degree phase shift mode, and the 45-degree phase shift mode, according to the number of connected LED strings. Such an arrangement allows the user to appropriately drive the light emitting diode strings merely by supplying a standby signal having a level that corresponds to the desired operating mode and a single dimming pulse signal having a duty ratio that corresponds to the desired luminance.

Another embodiment of the present invention relates to a light emitting apparatus. The light emitting apparatus comprises: at least one light emitting diode string; a switching power supply configured to supply a driving voltage to the aforementioned at least one light emitting diode string; and a current drive circuit according to any one of the aforementioned embodiments, configured to control the driving current that flows through the aforementioned at least one light emitting diode string.

Another embodiment of the present invention relates to an electronic device. The electronic device comprises: a liquid crystal panel; and the aforementioned light emitting apparatus arranged as a backlight of the liquid crystal panel.

It is to be noted that any arbitrary combination or rearrangement of the above-described structural components and so forth is effective as and encompassed by the present embodiments.

Moreover, this summary of the invention does not necessarily describe all necessary features so that the invention may also be a sub-combination of these described features.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

In the present specification, the state represented by the phrase "the member A is connected to the member B" includes a state in which the member A is indirectly connected to the member B via another member that does not substantially affect the electric connection therebetween, or that does not damage the functions or effects of the connection therebetween, in addition to a state in which the member A is physically and directly connected to the member B.

Similarly, the state represented by the phrase "the member C is provided between the member A and the member B" includes a state in which the member A is indirectly connected to the member C, or the member B is indirectly connected to the member C via another member that does not substantially affect the electric connection therebetween, or that does not damage the functions or effects of the connection therebetween, in addition to a state in which the member A is directly connected to the member C, or the member B is directly connected to the member C.

Figure 2:
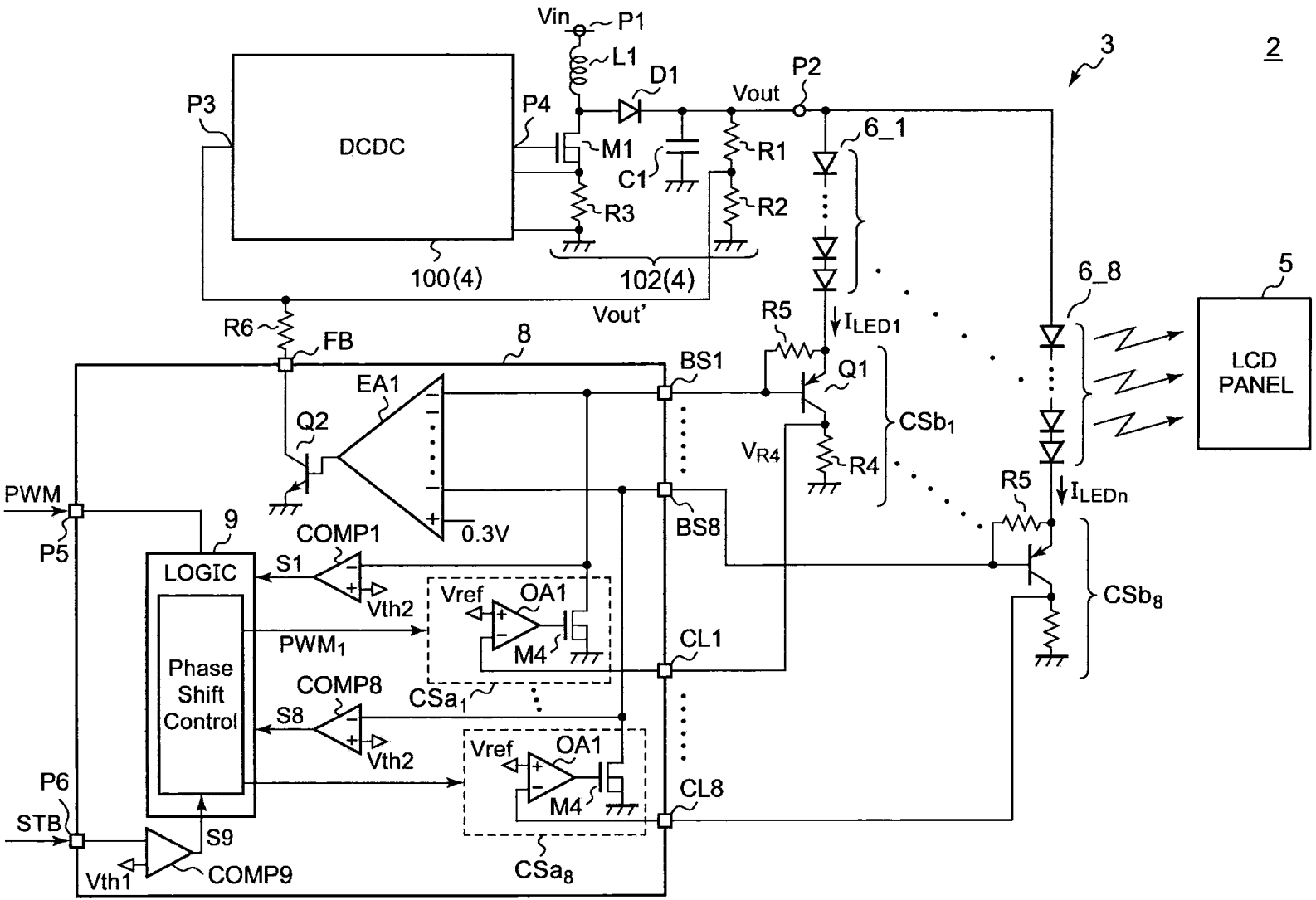
FIG. 2 is a circuit diagram which shows a configuration of an electronic device including a switching power supply according to an embodiment.

FIG. 2 is a circuit diagram which shows a configuration of an electronic device including a switching power supply according to an embodiment.

An electronic device 2 is configured as a battery-driven device such as a laptop PC, a digital still camera, a digital video camera, a cellular phone terminal, a PDA (Personal Digital Assistant), or the like. The electronic device 2 includes a light emitting apparatus 3 and an LCD (Liquid Crystal Display) panel 5. The light emitting apparatus 3 is arranged as a backlight of the LCD panel 5.

The light emitting apparatus 3 includes LED strings 6_1 through 6_n each configured as a light emitting element, a current drive circuit 8, and a switching power supply 4. The maximum number n of the channels is 8, which should be determined by the designer of the electronic device 2 based upon the size of the LCD panel 5 or the kind of the electronic device 2. That is to say, the number of the channels, i.e., n, can be determined as desired in a range from 1 to 8.

Each LED string 6 includes multiple LEDs connected in series. The switching power supply 4 is configured as a step-up DC/DC converter. The switching power supply 4 is configured to boost the input voltage (e.g., battery voltage) Vin input to an input terminal P1, and to output an output voltage (driving voltage) Vout via an output terminal P2. One terminal (anode) of each of the multiple LED strings 6_1 through 6_n is connected to the output terminal P2 so as to form a common anode terminal.

The switching power supply 4 includes a control IC 100 and an output circuit 102. The output circuit 102 includes an inductor L1, a rectifier diode D1, a switching transistor M1, and an output capacitor C1. The output circuit 102 has a typical topology, and accordingly, description thereof will be omitted.

A switching terminal P4 of the control IC 100 is connected to the gate of the switching transistor M1. The control IC 100 adjusts the on/off duty ratio of the switching transistor M1 by means of a feedback control operation so as to provide the output voltage Vout required to turn on the LED strings 6. It should be noted that the switching transistor M1 may be configured as a built-in component of the control IC 100.

The resistors R1 and R2 divide the output voltage Vout so as to generate a feedback voltage Vout' that corresponds to the output voltage Vout. The feedback voltage Vout' is input to a feedback terminal P3 (OVP terminal). When the feedback voltage Vout' exceeds a threshold value, an overvoltage protection circuit (not shown) performs an overvoltage protection operation.

The current drive circuit 8 is arranged on the other terminal (cathode) side of the multiple LED strings 6_1 through 6_n. The current drive circuit 8 respectively supplies, to the LED strings 6_1 through 6_n, intermittent driving currents $I_{LED1}$ through $I_{LEDn}$ that correspond to the respective target luminance levels.

The current drive circuit 8 includes multiple current sources $CS_1$ through $CS_n$ provided to the respective channels, a burst controller 9, a control input terminal P5, a standby terminal (STB terminal) P6, burst dimming terminals BS1 through BS8 provided to the respective channels, current control terminals CL1 through CL8 provided to the respective channels, comparators COMP1 through COMP8 provided to the respective channels, and a comparator COMP9.

The i-th current source $CS_i$ supplies a driving current $I_{LEDi}$ to the corresponding LED string 6_i. The current source $CS_i$ includes an output circuit $CSb_i$ and a control unit $CSa_i$. The output circuit $CSb_i$ includes an output transistor Q1, a current control resistor R4, and a pull-up resistor R5. The output transistor Q1 and the current control resistor R4 are sequentially connected in series between the cathode of the LED string 6_i and a fixed voltage terminal (ground terminal). A voltage $V_{R4}$ at a connection node that connects the output transistor Q1 and the current control resistor R4, i.e., voltage drop that occurs at the current control resistor R4 is input to the current control terminal $CL_i$. The pull-up resistor R5 is arranged between the base and emitter of the output transistor Q1.

At the resistor R4, a voltage drop $V_{R4}$ occurs in proportion to the driving current $I_{LEDi}$ $$V_{R4}=I_{LEDi}\times R4$$

The control unit $CSa_i$ adjusts the base voltage of the output transistor Q1 such that the corresponding voltage drop $V_{R4}$ matches a reference voltage Vref. That is to say, in the on period, the relation $I_{LEDi}$=Vref/R4 holds true.

The control unit $CSa_i$ includes an operational amplifier OA1 and a transistor M4. The transistor M4 is arranged between the burst dimming terminal BSi and the ground terminal. The operational amplifier OA1 is arranged such that the reference voltage Vref is input to its non-inverting input terminal (+), and the voltage $V_{R4}$ at the current control terminal CL is input to its inverting input terminal (−). The output voltage of the operational amplifier OA1 is input to the gate of the transistor M4. The current source $CS_i$ provides a feedback operation such that the relation $V_{R4}$=Vref holds true, thereby allowing each channel to generate the driving current $I_{LEDi}$ that corresponds to the reference voltage Vref.

The control input terminal P5 receives, as an input signal, a pulse-width modulated dimming pulse signal PWM which is used in the burst dimming operation. The first level (e.g., high level) of the dimming pulse signal PWM indicates the on period $T_{ON}$ of the LED string 6, and the second level (e.g., low level) thereof indicates the off period $T_{OFF}$. The duty ratio of the PWM dimming pulse signal PWM, i.e., the ratio between the on period $T_{ON}$ and the off period $T_{OFF}$, is common information used by all the channels.

The standby terminal P6 receives, as an input signal, a standby signal STB which indicates the standby state and the operating state of the current drive circuit 8. Specifically, when the standby signal STB is low level (e.g., 0 to 0.8 V), the current drive circuit 8 enters the standby state. When the standby signal STB is high level (higher than 0.8 V), the current drive circuit 8 enters the operating state, in which it supplies a driving current to the LED strings 6.

The burst controller 9 has the following switchable modes. The mode is switched according to the signal level $V_{STB}$ of the standby signal STB, and the voltage levels $V_{BS1}$ through $V_{BS8}$ at the respective burst dimming terminals BS1 through BS8 for the eight respective channels.

a. All Channel Common Mode $\phi_{COM}$

In this mode, the burst controller 9 does not perform a phase shift operation. Specifically, the LED strings of all the channels to be driven are driven using driving currents $I_{LED}$ having the uniform phase. In this mode, the phase difference between all the respective channel driving currents is zero. Accordingly, this mode will also be represented by $\phi_0$.

b. Phase Shift Mode $\phi_{SHIFT}$

In this mode, the burst controller 9 drives the light emitting diode strings for the respective channels such that the phases of the respective driving currents are shifted. The phase shift mode b includes the following three modes.

b1. 90-Degree Phase Shift Mode $\phi_{90}$

In this mode, the first channel through the fourth channel are set as the driving targets. The driving currents $I_{LED1}$ through $I_{LED4}$ are applied to the respective LED strings 6_1 through 6_4 such that their phases are shifted from one another by ¼ the period of the dimming pulse signal PWM.

b2. 60-Degree Phase Shift Mode $\phi_{60}$

In this mode, the driving currents $I_{LED1}$ through $I_{LED6}$ are applied to the respective LED strings 6_1 through 6_6 such that their phases are shifted from one another by ⅙ the period of the dimming pulse signal PWM.

b3. 45-Degree Phase Shift Mode $\phi_{45}$

In this mode, the driving currents $I_{LED1}$ through $I_{LED8}$ are applied to the respective LED strings 6_1 through 6_8 such that their phases are shifted from one another by ⅛ the period of the dimming pulse signal PWM.

The burst controller 9 generates the burst control signals $PWM_1$ through $PWM_8$ according to a particular mode, and supplies the burst control signals $PWM_1$ through $PWM_8$ thus generated to the respective current sources $CS_1$ through $CS_B$. When the burst control signal $PWM_i$ is high level, the current source $CS_i$ enters the operating state in which it generates the driving current $I_{LEDi}$, which thereby becomes the ON period $T_{ON}$. Conversely, when the burst control signal $PWM_i$ is low level, the current source $CS_i$ enters the stopped state, which thereby becomes the off period $T_{OFF}$.

Figure 3:
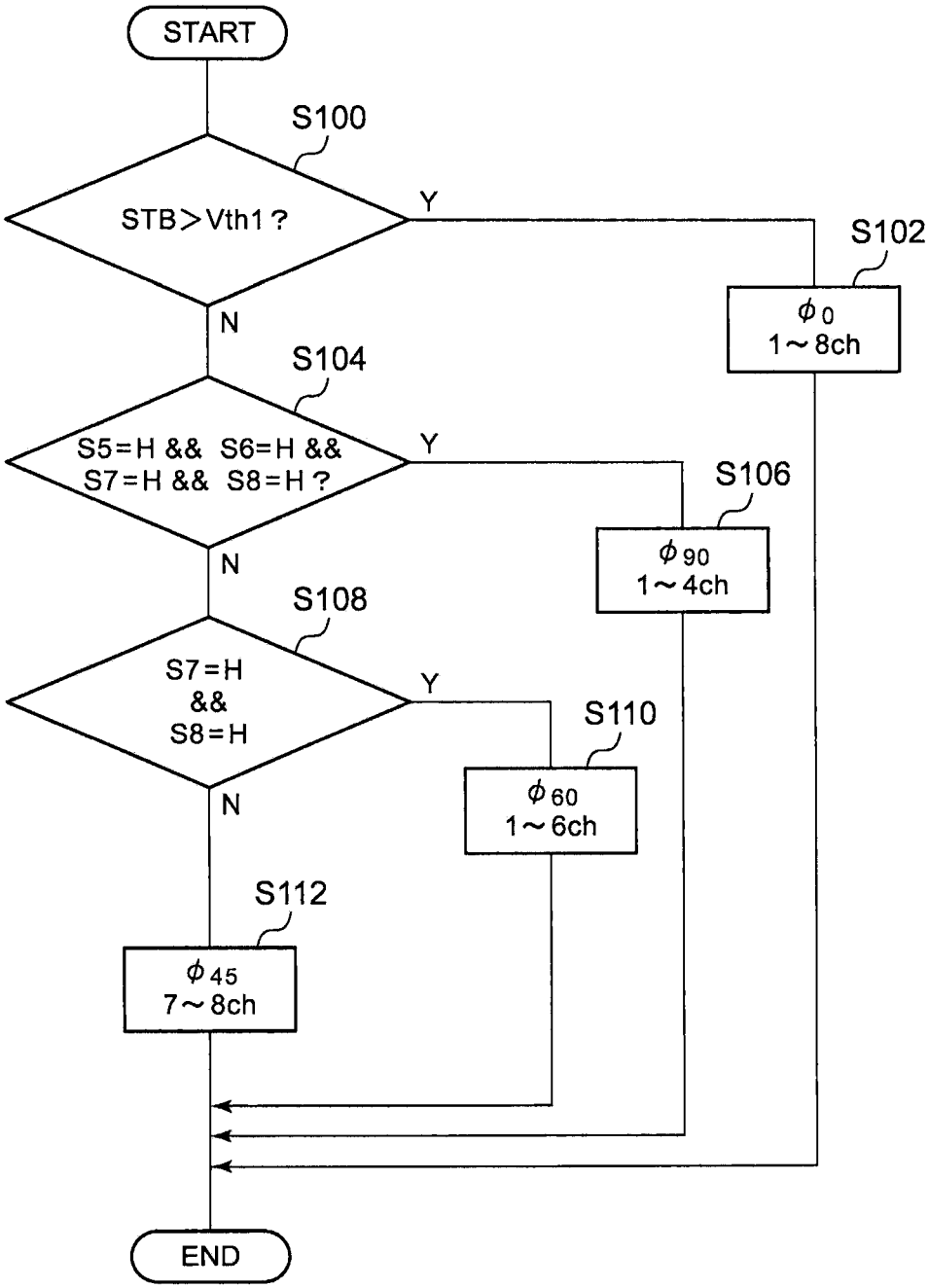
FIG. 3 is a flowchart for determining the operating mode of the current drive circuit shown in FIG. 2.

A judgment period $T_{JDG}$ is provided for a predetermined period after the standby signal STB switches from low level to high level, i.e., after the standby signal STB is asserted. The judgment period $T_{JDG}$ is on the order of several periods of the dimming pulse signal PWM, and specifically is on the order of three periods of the dimming pulse signal PWM. In the judgment period $T_{JDG}$, the burst controller 9 judges the mode based upon the voltage level $V_{STB}$ of the standby signal STB and the voltage levels $V_{BS1}$ through $V_{BS8}$ at the respective burst dimming terminals BS1 through BS8 of the eight respective channels. FIG. 3 is a flowchart for determining the operating mode of the current drive circuit 8 shown in FIG. 2.

First, the burst controller 9 determines the operating mode according to the voltage level $V_{STB}$ of the standby signal STB. When the voltage level $V_{STB}$ of the standby signal STB is included in a predetermined first range, the mode is set to the all channel common mode $\phi_0$. The comparator COMP9 compares the voltage $V_{STB}$ with a threshold voltage Vth1, and outputs a judgment signal S9 which represents the comparison result. When the judgment signal S9 represents the comparison result $V_{STB}$>Vth1 (YES in S100), the burst controller 9 sets the mode to the all channel common mode $\phi_0$ (S102).

When the voltage level $V_{STB}$ of the standby signal STB is included in a predetermined second voltage range, the burst controller 9 is set to the phase shift mode $\phi_{SHIFT}$. The second voltage range is a range in which the relation $V_{STB}$<Vth1 is satisfied. Accordingly, when the judgment signal S9 represents the comparison result $V_{STB}$<Vth1 (NO in S100), the burst controller 9 is set to the phase shift mode $\phi_{SHIFT}$.

Subsequently, the burst controller 9 thus set to the phase shift mode $\phi_{SHIFT}$ is further set to any one of the 90-degree phase shift mode, the 60-degree phase shift mode, and the 45-degree phase shift mode, based upon the voltage levels $V_{BS1}$ through $V_{BS8}$ of the respective channel burst dimming terminals BS.

The comparators COMP1 through COMP8 are provided to the respective channels, and are configured to compare the respective channel voltages $V_{BS1}$ through $V_{BS8}$ with a predetermined threshold voltage Vth2. The threshold voltage Vth2 is preferably set to be on the order of 0.1 V, for example. The i-th channel comparator COMPi outputs an detection signal Si which is set to high level (H) when $V_{BSi}$ is lower than Vth2, and which is set to low level (L) when $V_{BSi}$ is higher than Vth2.

When the LED string 6_i is connected to the i-th burst dimming terminal BSi, if the driving current $I_{LEDi}$ is zero, the voltage level $V_{BSi}$ rises up to the vicinity of the output voltage Vout. On the other hand, when the LED string 6_i is not connected to the burst dimming terminal BSi, the voltage level $V_{BSi}$ at the burst dimming terminal BSi drops to the vicinity of the ground voltage. That is to say, the output signal Si of the comparator COMPi indicates whether or not the LED string 6_i is connected to the i-th burst dimming terminal BSi.

In the judgment period $T_{JDG}$, when all the electric potentials $V_{BS5}$ through $V_{BS8}$ at the respective burst dimming terminals BS5 through BS8 of the fifth channel through the eighth channel are lower than the predetermined threshold voltage Vth2, i.e., when the conditional expression S5=H && S6=H && S7=H && S8=H is satisfied (YES in S104), the burst controller 9 is set to the 90-degree shift mode $\phi_{90}$ (S106). This represents a state in which the LED strings 6_5 through 6_8 are not connected to the respective fifth through eighth channels. (A=B) represents an operator which is set to true (1) when A is equal to B, and which is set to false (0) when A is not equal to B. "&&" represents an operator which generates the logical AND.

When the aforementioned conditional expression is not satisfied (NO in S104), the flow proceeds to Step S106. When the electric potentials $V_{BS7}$ and $V_{BS8}$ at the respective burst dimming terminals BS7 and BS8 of the seventh and eighth channels are each lower than the second threshold voltage Vth2, i.e., when the conditional expression S7=H && S8=H is satisfied (YES in S108), the first through sixth channels are set as the driving targets. Thus, the mode is set to the 60-degree phase shift mode $\phi_{60}$ (S110).

In other cases (NO in S108), all the channels are set as the driving targets. Thus, the mode is set to the 45-degree phase shift mode $\phi_{45}$ (S112).

As described above, judgment of whether or not an LED string 6 has been connected is made for each individual channel. During the driving period, an error amplifier EA1 amplifies the difference between a reference voltage (e.g., 0.3 V) and the lowest of the voltages $V_{BS}$ at the respective channels to which the respective LED strings 6 have been connected, so as to generate an error voltage Verr that corresponds to the difference thus generated. The error voltage Verr is output from an FB terminal via a transistor Q2 and a resistor R6, and is input to a feedback terminal of the control IC 100. During the driving period, the control IC 100 adjusts the output voltage Vout such that the reference voltage (e.g., 0.3 V) matches the lowest of the voltages $V_{BS}$ at the channels to which LED strings 6 have been connected.

Figure 4:
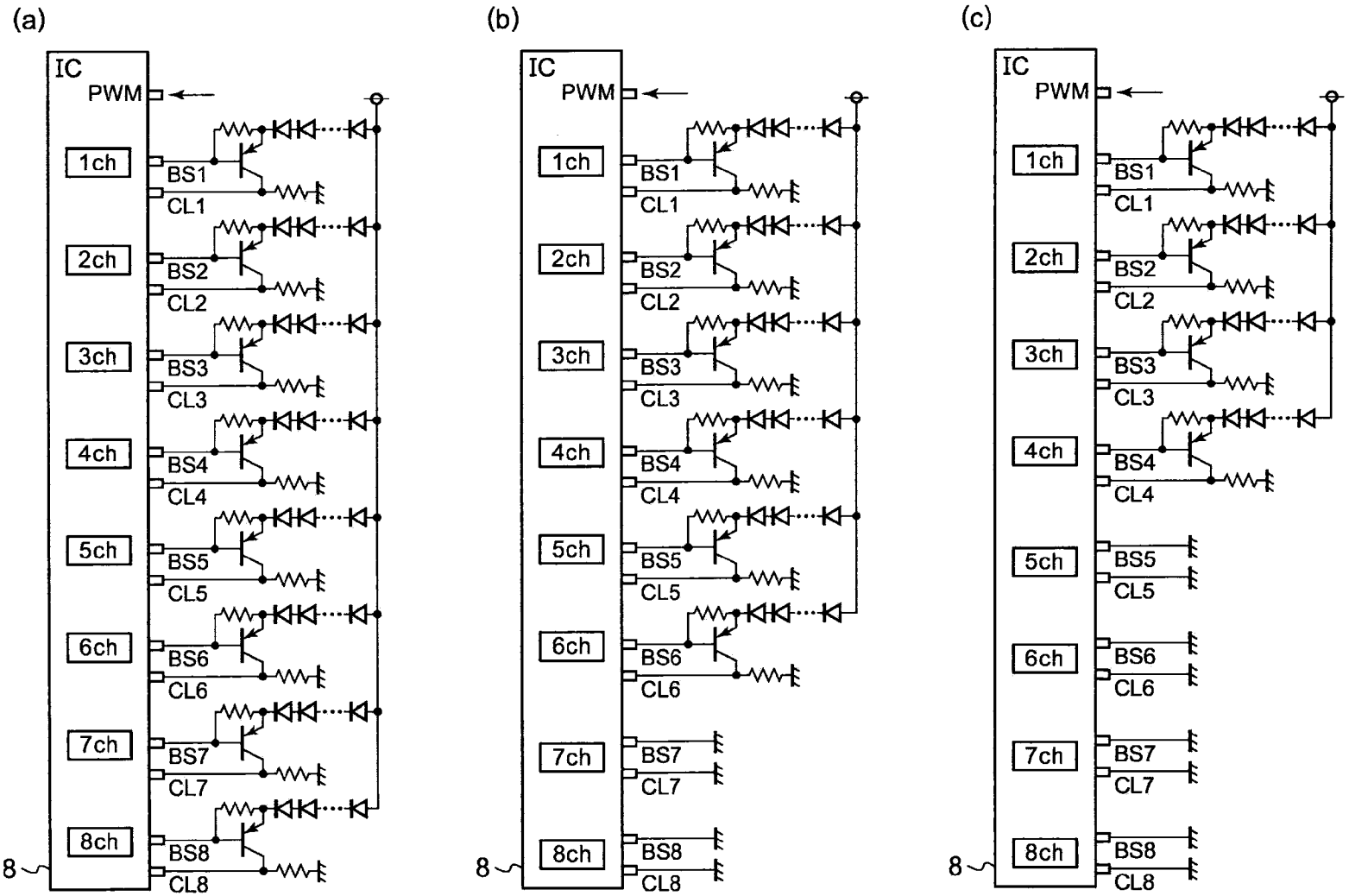
FIGS. 4A through 4C are circuit diagrams each showing a configuration of a peripheral circuit of the current drive circuit.

The above is the configuration of the light emitting apparatus 3. Next, description will be made regarding the operation thereof. FIGS. 4A through 4C are circuit diagrams each showing a configuration of a peripheral circuit of the current drive circuit 8. In a case in which no LED string 6 is connected to a given channel, the burst dimming terminal BS and the current control terminal CL for that channel are grounded.

FIG. 4A shows a case in which the LED strings 6_1 through 6_8 are connected to all the respective channels. When the voltage level $V_{STB}$ of the standby signal STB is included in the first voltage range, the mode is set to the all channel common mode $\phi_0$. In the all channel common mode $\phi_0$, all the burst control signals $PWM_1$ through $PWM_8$ of the respective channels have the same waveform as that of the dimming pulse signal PWM. Thus, all the LED strings 6_1 through 6_8 of the respective channels are driven by the respective driving currents $I_{LED1}$ through ILED8 having the same phase.

Figure 5:
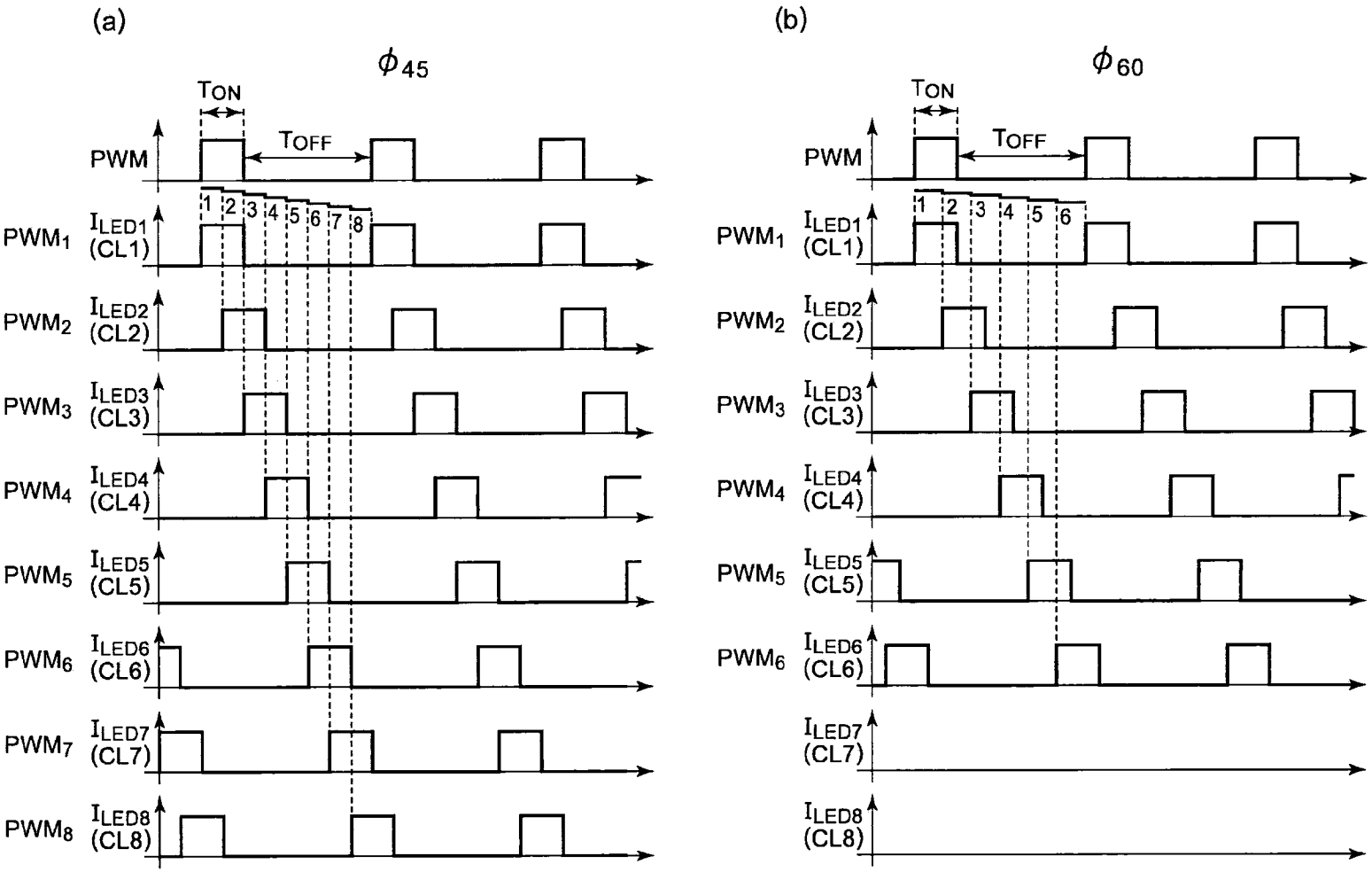
FIGS. 5A and 5B are diagrams which show the operation waveforms in the 45-degree shift mode and the 60-degree shift mode, respectively.

Conversely, when the voltage level $V_{STB}$ of the standby signal STB is included in the second voltage range, the mode is set to the phase shift mode $\phi_{SHIFT}$. In a case in which LED strings are connected to all the respective channels as shown in FIG. 4A, the mode is set to the 45-degree phase shift mode $\phi_{45}$. FIG. 5A shows the operation waveforms in the 45-degree phase shift mode $\phi_{45}$. These operation waveforms represent the burst control signals $PWM_1$ through $PWM_8$, and also represent driving currents $I_{LED1}$ through ILED8 that flow through the respective channels.

FIG. 4B shows a state in which the LED strings 6_1 through 6_6 are connected to the first through sixth channels. When the voltage level $V_{STB}$ of the standby signal STB is included in the second voltage range, the mode is set to the 60-degree phase shift mode $\phi_{60}$. FIG. 5B shows the waveforms in the 60-degree phase shift mode $\phi_{60}$.

FIG. 4C shows a state in which the LED strings 6_1 through 6_4 are connected to the first through fourth channels. When the voltage level $V_{STB}$ of the standby signal STB is included in the second voltage range, the mode is set to the 90-degree phase shift mode $\phi_{90}$.

The above is the operation of the light emitting apparatus 3.

With a typical IC (Integrated Circuit), the standby signal STB is configured as a binary signal. When the standby signal STB is set to high level, the IC is set to the operating state, and when the standby signal is set to low level, the IC is set to the standby state. With such an embodiment, the mode can be switched between the all channel common mode $\phi_{COM}$ ($\phi_0$) and the phase shift mode $\phi_{SHIFT}$ using the voltage level of the standby signal STB which indicates the operating state.

Furthermore, such an arrangement is capable of automatically setting the phase shift angle according to the number of LED strings 6 that have been connected to the current drive circuit 8. That is to say, when the standby signal STB is included in the second voltage range, mode switching can be performed between the 90-degree phase shift mode, 60-degree phase shift mode, and 45-degree phase shift mode according to the number of LED strings that have been connected. To drive the LED strings 6, such an arrangement only requires the user to supply a standby signal STB having a level that corresponds to the desired operating mode and a single dimming pulse signal PWM having a duty ratio that corresponds to the desired luminance, thereby allowing the user to drive the LED strings 6 in a simple manner.

Description has been made regarding the present invention with reference to the embodiments. The above-described embodiment has been described for exemplary purposes only, and is by no means intended to be interpreted restrictively. Rather, various modifications may be made by making various combinations of the aforementioned components or processes. Description will be made below regarding such modifications.

Figure 1:
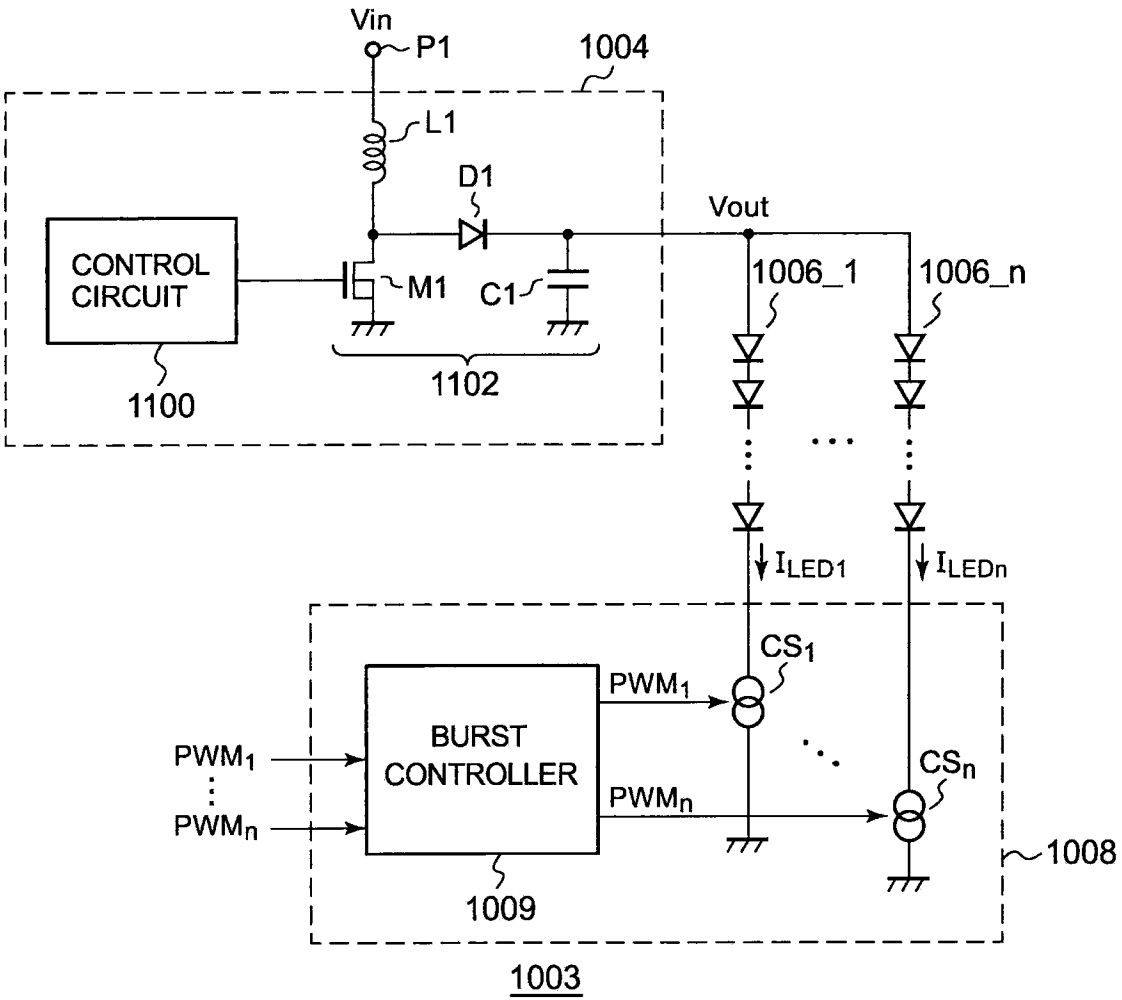
FIG. 1 is a circuit diagram which shows a configuration of a typical light emitting apparatus.
Figure 6:
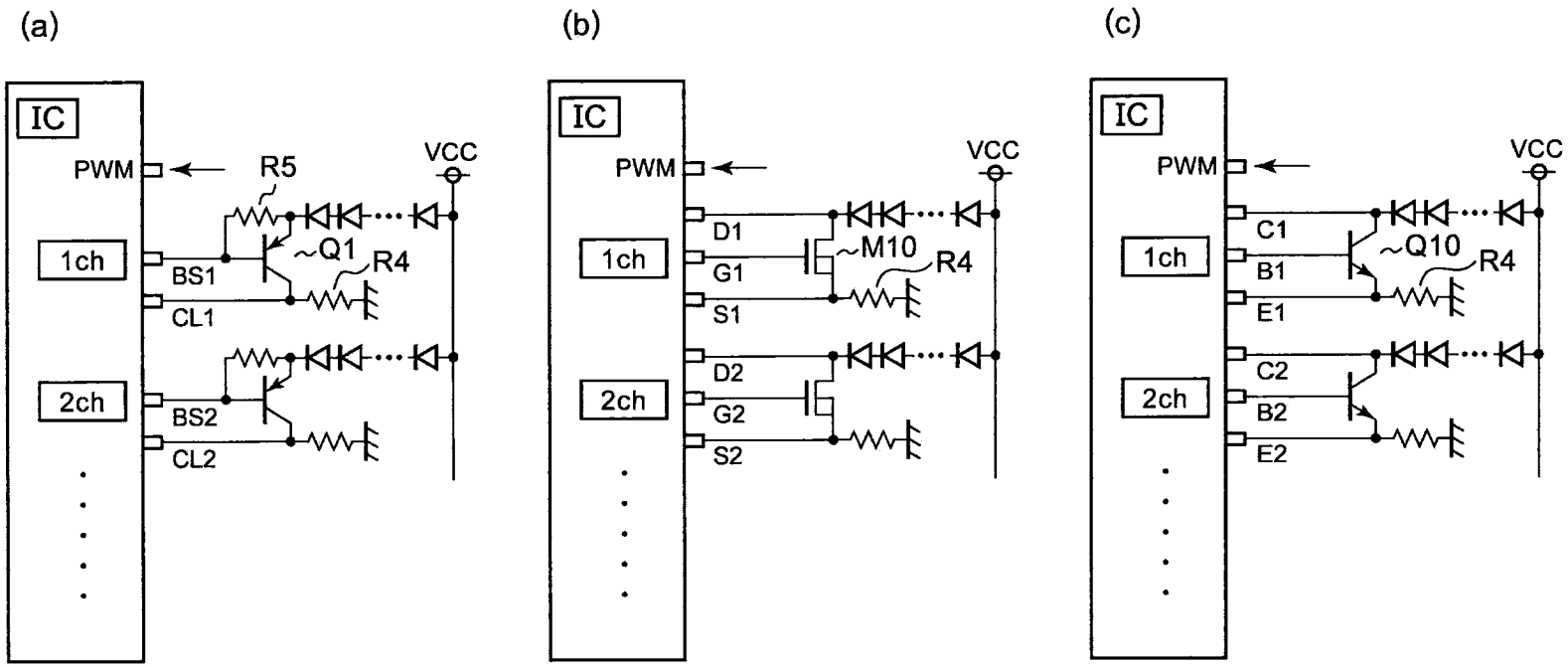
FIGS. 6A through 6C are circuit diagrams each showing an example configuration of an output circuit of a current source.

The configuration of the current source CS is not restricted to such a configuration shown in FIG. 2. Rather, it can be understood that various modifications may be made. FIGS. 6A through 6C are circuit diagrams each showing an example configuration of the output circuit CSb of the current source CS. FIG. 6A shows the same configuration as that shown in FIG. 2. FIG. 6B shows a circuit employing an N-channel MOS transistor M10, instead of the transistor Q1 shown in FIG. 1. With such an arrangement, the pull-up resistor R5 can be omitted. FIG. 6C shows a circuit including an NPN bipolar transistor Q10 instead of the transistor M10 shown in FIG. 6B. Various modifications may be made with respect to the control unit CSa of the current source CS, which can be understood by those skilled in this art.

Description has been made in the embodiment regarding a non-isolated switching power supply employing an inductor. Also, the present invention can be applied to an isolated switching power supply employing a transformer.

Description has been made in the embodiment regarding an electronic device as an application of the light emitting apparatus 3. However, the application of the light emitting apparatus 3 is not restricted in particular. Also, the light emitting apparatus 3 can be applied to an illumination device and so forth.

The settings of the logical signals, such as the high-level state and the low-level state of the signals, have been described in the present embodiment for exemplary purposes only. The settings can be freely modified by inverting the signals using inverters or the like.

While the preferred embodiments of the present invention have been described using specific terms, such description is for illustrative purposes only, and it is to be understood that changes and variations may be made without departing from the spirit or scope of the appended claims.

What is claimed is:

1. A current drive circuit configured to allow a maximum of eight channels of light emitting diode strings to be connected, and to drive the light emitting diode strings thus connected, the current drive circuit comprising:

a control input terminal configured to receive a pulse width modulated dimming pulse signal;

a standby terminal configured to receive a standby signal which is an instruction to switch the state of the current drive circuit between a standby state and an operating state;

eight burst dimming terminals respectively provided to the channels, and each configured to receive a voltage that occurs at one terminal of the corresponding diode string; and a controller configured such that, when the voltage level of the standby signal is included in a first voltage range, the operating mode is set to an all channel common mode in which the light emitting diode strings of the respective channels are each driven using a corresponding driving current having the same phase, and when the voltage level of the standby signal is included in a second voltage range, the mode is set to a phase shift mode in which the light emitting diode strings of the respective channels are each driven using a corresponding driving current having a shifted phase, wherein the controller set to the phase shift mode performs a driving operation such that, when the electric potentials at the burst dimming terminals of the fifth through eighth channels are all lower than a predetermined second threshold voltage in a judgment period, the mode is set to a 90-degree phase shift mode in which the light emitting diode strings of the first through fourth channels are driven in a driving period after the judgment period using respective driving currents the phases of which are shifted from one another by ¼ the period of the dimming pulse signal, and, when the electric potentials at the burst dimming terminals of the seventh and eighth channels are all lower than the predetermined second threshold voltage in the judgment period, the mode is set to a 60-degree phase shift mode in which the light emitting diode strings of the first through sixth channels are driven in the driving period after the judgment period using respective driving currents the phases of which are shifted from one another by ⅙ the period of the dimming pulse signal, and, in cases other than the foregoing, the mode is set to a 45-degree phase shift mode in which the light emitting diode strings of the first through eighth channels are driven in the driving period after the judgment period using respective driving currents the phases of which are shifted from one another by ⅛ the period of the dimming pulse signal.

2. A light emitting apparatus comprising:

at least one light emitting diode string;

a switching power supply configured to supply a driving voltage to the aforementioned at least one light emitting diode string; and a current drive circuit configured to control the driving current that flows through the aforementioned at least one light emitting diode string, wherein the current drive circuit is configured to allow a maximum of eight channels of light emitting diode strings to be connected, and to drive the light emitting diode strings thus connected, and wherein the current drive circuit comprises:

a control input terminal configured to receive a pulse width modulated dimming pulse signal;

a standby terminal configured to receive a standby signal which is an instruction to switch the state of the current drive circuit between a standby state and an operating state;

eight burst dimming terminals respectively provided to the channels, and each configured to receive a voltage that occurs at one terminal of the corresponding diode string; and a controller configured such that, when the voltage level of the standby signal is included in a first voltage range, the operating mode is set to an all channel common mode in which the light emitting diode strings of the respective channels are each driven using a corresponding driving current having the same phase, and when the voltage level of the standby signal is included in a second voltage range, the mode is set to a phase shift mode in which the light emitting diode strings of the respective channels are each driven using a corresponding driving current having a shifted phase, wherein the controller set to the phase shift mode performs a driving operation such that, when the electric potentials at the burst dimming terminals of the fifth through eighth channels are all lower than a predetermined second threshold voltage in a judgment period, the mode is set to a 90-degree phase shift mode in which the light emitting diode strings of the first through fourth channels are driven in a driving period after the judgment period using respective driving currents the phases of which are shifted from one another by ¼ the period of the dimming pulse signal, and, when the electric potentials at the burst dimming terminals of the seventh and eighth channels are all lower than the predetermined second threshold voltage in the judgment period, the mode is set to a 60-degree phase shift mode in which the light emitting diode strings of the first through sixth channels are driven in the driving period after the judgment period using respective driving currents the phases of which are shifted from one another by ⅙ the period of the dimming pulse signal, and, in cases other than the foregoing, the mode is set to a 45-degree phase shift mode in which the light emitting diode strings of the first through eighth channels are driven in the driving period after the judgment period using respective driving currents the phases of which are shifted from one another by ⅛ the period of the dimming pulse signal.

3. An electronic device comprising:

a liquid crystal panel; and a light emitting apparatus arranged as a backlight of the liquid crystal panel, the light emitting apparatus comprising:

at least one light emitting diode string;

a switching power supply configured to supply a driving voltage to the aforementioned at least one light emitting diode string; and a current drive circuit configured to control the driving current that flows through the aforementioned at least one light emitting diode string, wherein the current drive circuit is configured to allow a maximum of eight channels of light emitting diode strings to be connected, and to drive the light emitting diode strings thus connected, and wherein the current drive circuit comprises:

a control input terminal configured to receive a pulse width modulated dimming pulse signal;

a standby terminal configured to receive a standby signal which is an instruction to switch the state of the current drive circuit between a standby state and an operating state;

eight burst dimming terminals respectively provided to the channels, and each configured to receive a voltage that occurs at one terminal of the corresponding diode string; and a controller configured such that, when the voltage level of the standby signal is included in a first voltage range, the operating mode is set to an all channel common mode in which the light emitting diode strings of the respective channels are each driven using a corresponding driving current having the same phase, and when the voltage level of the standby signal is included in a second voltage range, the mode is set to a phase shift mode in which the light emitting diode strings of the respective channels are each driven using a corresponding driving current having a shifted phase, wherein the controller set to the phase shift mode performs a driving operation such that, when the electric potentials at the burst dimming terminals of the fifth through eighth channels are all lower than a predetermined second threshold voltage in a judgment period, the mode is set to a 90-degree phase shift mode in which the light emitting diode strings of the first through fourth channels are driven in a driving period after the judgment period using respective driving currents the phases of which are shifted from one another by ¼ the period of the dimming pulse signal, and, when the electric potentials at the burst dimming terminals of the seventh and eighth channels are all lower than the predetermined second threshold voltage in the judgment period, the mode is set to a 60-degree phase shift mode in which the light emitting diode strings of the first through sixth channels are driven in the driving period after the judgment period using respective driving currents the phases of which are shifted from one another by ⅙ the period of the dimming pulse signal, and, in cases other than the foregoing, the mode is set to a 45-degree phase shift mode in which the light emitting diode strings of the first through eighth channels are driven in the driving period after the judgment period using respective driving currents the phases of which are shifted from one another by ⅛ the period of the dimming pulse signal.

4. A driving mode setting method for a maximum of eight channels of light emitting diode strings, the setting method comprising:

setting the mode, when the voltage level of a standby signal that indicates switching between a standby state and an operating state is included in a predetermined first voltage range, to an all channel common mode in which the light emitting diode strings of the respective channels are each driven using a corresponding driving current having the same phase; and setting the mode, when the voltage level of the standby signal is included in a second voltage range, to a phase shift mode in which the light emitting diode strings of the respective channels are each driven using a corresponding driving current having a shifted phase, wherein setting the mode to the phase shift mode comprises:

setting the mode, when judgment is made in a judgment period that no light emitting diode string is connected to the fifth through eighth channels, to a 90-degree phase shift mode in which the light emitting diode strings of the first through fourth channels are driven using respective driving currents the phases of which are shifted from one another by ¼ the period of the dimming pulse signal;

setting the mode, when judgment is made in the judgment period that no light emitting diode string is connected to the seventh and eighth channels, to a 60-degree phase shift mode in which the light emitting diode strings of the first through sixth channels are driven using respective driving currents the phases of which are shifted from one another by ⅙ the period of the dimming pulse signal; and setting the mode, in cases other than the foregoing, to a 45-degree phase shift mode in which the light emitting diode strings of the first through eighth channels are driven using respective driving currents the phases of which are shifted from one another by ⅛ the period of the dimming pulse signal.

* * * * *